US010739057B2

(12) United States Patent
Segawa et al.

(10) Patent No.: US 10,739,057 B2
(45) Date of Patent: Aug. 11, 2020

(54) REFRIGERATOR

(71) Applicant: Panasonic Corporation, Osaka (JP)

(72) Inventors: Terutsugu Segawa, Osaka (JP); Fuminori Takami, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 115 days.

(21) Appl. No.: 15/684,429

(22) Filed: Aug. 23, 2017

(65) Prior Publication Data

US 2018/0073796 A1 Mar. 15, 2018

(30) Foreign Application Priority Data

Sep. 12, 2016 (JP) ..... 2016-177394
May 25, 2017 (JP) ..... 2017-103642

(51) Int. Cl.
*F25D 21/08* (2006.01)
*F25D 17/04* (2006.01)
*F25D 11/02* (2006.01)

(52) U.S. Cl.
CPC ..... *F25D 21/08* (2013.01); *F25D 17/045* (2013.01); *F25D 11/02* (2013.01); *F25D 2201/124* (2013.01)

(58) Field of Classification Search
CPC ..... F25D 21/08; F25D 17/045; F25D 17/00; F25D 17/04; F25D 17/042; F25D 17/06; F25D 17/062; F25D 17/067; F25D 17/08; F25D 11/02; F25D 2201/00; F25D 2201/128; F25D 2201/124; F25D 2317/067; F25D 2317/0671; F25D 2317/0672; F25D 2321/1413; F25D 2400/02; F25B 47/00; F25B 47/006; F25B 47/02
USPC ..... 62/276, 419
See application file for complete search history.

(56) References Cited

U.S. PATENT DOCUMENTS

2002/0184900 A1* 12/2002 Wellman ..... A47F 3/0443 62/155
2006/0266075 A1* 11/2006 Itsuki ..... F25B 1/10 62/512
2013/0098078 A1* 4/2013 Contreras Lafaire ... F25D 21/06 62/82

(Continued)

FOREIGN PATENT DOCUMENTS

DE 102010003091 * 9/2011 ..... F25D 17/042
EP 2789940 10/2014

(Continued)

OTHER PUBLICATIONS

Machine translation of DE102010003091, published Sep. 2011.*

*Primary Examiner* — Joseph F Trpisovsky
(74) *Attorney, Agent, or Firm* — McDermott Will & Emery LLP

(57) ABSTRACT

A refrigerator configured to have enhanced energy efficiencies during the defrosting process, thus delivering excellent energy-saving performance. The refrigerator, includes: a cooler that produce a cold air; a defrosting heater that is placed under the cooler; a cooler cover that covers the cooler, an inlet-side space leading to the cooler, an outlet-side space extending from the cooler, and a connection space connecting the inlet-side space and the outlet-side space to one another; an inlet damper that opens and closes the inlet-side space; and a connection damper that opens and closes the connection space.

16 Claims, 7 Drawing Sheets

(56) References Cited

U.S. PATENT DOCUMENTS

| | | | | |
|---|---|---|---|---|
| 2015/0033773 | A1* | 2/2015 | Tajima | F25D 17/045<br>62/80 |

FOREIGN PATENT DOCUMENTS

| | | | |
|---|---|---|---|
| JP | 48-011469 | U | 2/1973 |
| JP | 2-085983 | U | 7/1990 |
| JP | 10-232079 | A | 9/1998 |
| JP | 2004-340415 | A | 12/2004 |
| JP | 2010-060188 | | 3/2010 |
| JP | 2012-057910 | | 3/2012 |
| JP | 2013-139982 | | 7/2013 |
| JP | 2013-200074 | A | 10/2013 |
| JP | 2014-211221 | A | 11/2014 |

* cited by examiner

REFRIGERATOR

TECHNICAL FIELD

The technical field relates to a refrigerator that is provided with a defrosting heater.

BACKGROUND

In recent years, with progress of saving of energy in refrigerators, methods for improving cooling efficiencies, and methods for improving defrosting efficiencies in melting frost that adheres onto coolers have been developed for reducing amounts of power consumption in refrigerators.

As an example of conventional refrigerators that reduce amounts of power consumption in refrigerators, a refrigerator disclosed in JP-A-2010-60188 can be mentioned. In the disclosed refrigerator, the air that has been heated by a defrosting heater is prevented from flowing into a chamber to suppress elevation of the temperature of the chamber, thereby securing energy-saving effects. Furthermore, for example, a refrigerator disclosed in JP-2012-57910 can also be mentioned. In the disclosed refrigerator, radiation heat released from a defrosting heater is transmitted to a cooler, based on a heat-transfer plate, to enhance heating efficiencies.

Hereinafter, the above-mentioned conventional refrigerators will be described with reference to drawings.

FIG. 6 is a cross-section view of an area around a cooler in the refrigerator disclosed in JP-A-2010-60188. The cooler 601 is placed inside a cooling chamber 603. The cooling chamber 603 is a region that is formed at the rear of a freezing chamber 602 by a cooler cover 604.

At the front lower side of the cooler 601, a cold-air inlet 605 that is configured by the cooler cover 604 opens, and thus, the cold air is circulated. A warm-air-inflow space 606 is provided between the chamber-facing side of the cooler cover 604 and the side thereof facing the cooler 601. A bottom of the warm-air-inflow space 606 opens, and the air that has been heated by the defrosting heater 607 flows into the warm-air-inflow space 606.

According to the disclosed structure, a larger amount of the air that has been heated by the defrosting heater 607 during the defrosting process flows into the warm-air-inflow space 606, compared with the air flowing into the chamber. Therefore, it becomes possible to suppress elevation in the temperature inside the chamber and achieve high energy-saving capability since an amount of thermal energy that has been required to heat the chamber during the defrosting process can be reduced.

FIG. 7 is a detailed side sectional view of an area around a cooler in the refrigerator disclosed in JP-2012-57910. The refrigerator is provided with a heat-transfer plate 703 that is formed by a metal material having higher heat conductivity. The heat-transfer plate 703 has a heat-absorbing part 703A that directly receives radiation heat from a defrosting heater 702, and a heat-releasing part 703B that is placed in close contact with a cooler 701 to cover the rear of the cooler 701.

Since a radiation-heat-absorbing means 704 for absorbing radiation heat from the defrosting heater 702 is provided on a surface of the heat-absorbing part 703A in which the surface opposes the defrosting heater 702, the radiation heat from the defrosting heater 702 will be efficiently transmitted even to an area of the cooler 701 that is remote from the defrosting heater 702. Accordingly, it becomes possible to efficiently melt frost on the cooler 701, and thus, energy-saving properties of the defrosting apparatus (refrigerator) can be improved based on reductions in the time required for the defrosting process, and reductions in the capacity of the defrosting heater 702.

SUMMARY

The conventional refrigerator disclosed in JP-A-2010-60188 in fact brings about energy-saving effects based on suppression of inflow of the heated air into the chamber from the defrosting heater during the defrosting process, and the resulting reductions in the thermal energy.

However, the conventional refrigerator cannot avoid elevation of the temperature inside the warm-air-inflow space itself. Therefore, in particular, a temperature around the inner back side of the chamber would be affected by heat transmission from the warm-air-inflow space, the temperature inside which has been elevated, to the inside of the chamber.

Furthermore, since a return port for the cold air coming front the chamber in the refrigerator is not closed, a certain amount of the heated air flows into the freezing chamber in proportion to some amount of the cold air flows into the cooler room. Therefore, there has been a problem in which the conventional refrigerator cannot avoid elevation of the temperature inside the chamber.

Consequently, since food stored therein are influenced by the temperature variations, there has been a problem in which the foods are warmed, and the insides of foods are almost repeatedly frozen and melted, thus causing deteriorations in the freshness.

Furthermore, the conventional refrigerator disclosed in JP-2012-57910 in fact has effects to efficiently absorb and transfer the radiation heat from the defrosting heater.

However, in order to transfer an amount of heat required for the defrosting process through the heat-transfer plate, it is required that the heat-transfer plate has a considerable thickness. Consequently, there is a problem in which a considerable amount of energy is consumed for cooling the heated heat-transfer plate after the defrosting process. Furthermore, since a return port for the cold air coming from the chamber in the refrigerator is not closed, there is a problem in which the heat-transfer plate is cooled by the cold air flowing into the cooling chamber. Additionally, a certain amount of the heated air flows into the freezing chamber in proportion as some amount of the cold air flows into the cooler room. Therefore, there has been a problem in which the conventional refrigerator cannot avoid elevation of the temperature inside the chamber.

Thus, in consideration of the above-mentioned problems, an object of the disclosure is to provide a refrigerator that makes it possible to enhance energy efficiencies during the defrosting process, thus delivering excellent energy-saving performance.

In order to achieve the above object, according to an aspect of the disclosure, provided is a refrigerator, including: a cooler that produce a cold air; a defrosting heater that is placed under the cooler; a cooler cover that covers the cooler, an inlet-side space leading to the cooler, an outlet-side space extending from the cooler, and a connection space connecting the inlet-side space and the outlet-side space to one another; an inlet damper that opens and closes the inlet-side space; and a connection damper that opens and closes the connection space.

According to the refrigerator of the disclosure, it becomes possible to enhance energy efficiencies during the defrosting process, thus realizing excellent energy-saving performance.

DESCRIPTION OF EMBODIMENTS

Hereinafter, embodiments of the disclosure will be described with reference to the drawings. However, detailed descriptions will be omitted of the same structures as those found in the conventional arts, and parts having no differences as compared with the conventional arts.

First Embodiment

Figure 1:
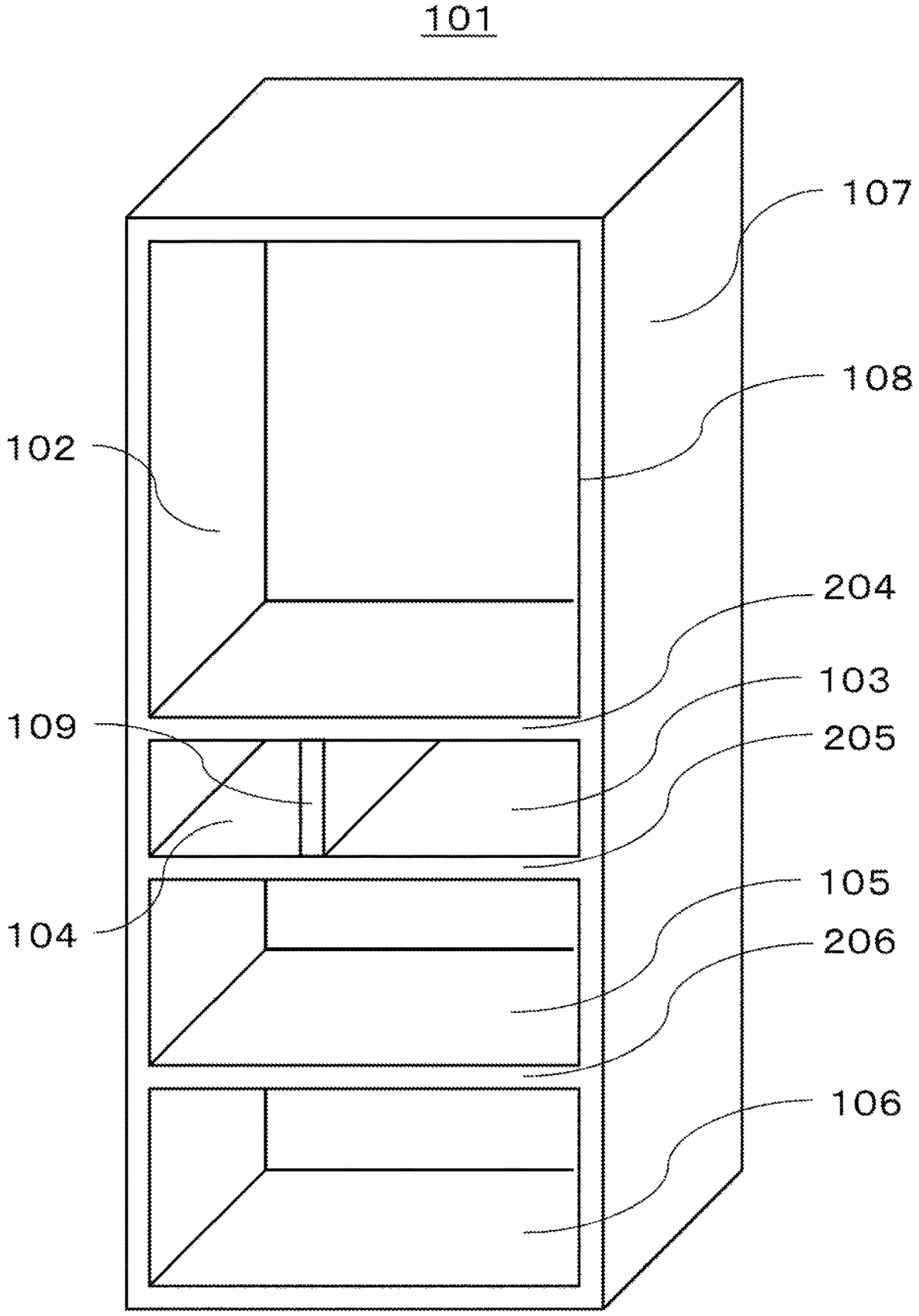
FIG. 1 is a perspective view of a refrigerator according to a first embodiment of the disclosure.
Figure 2:
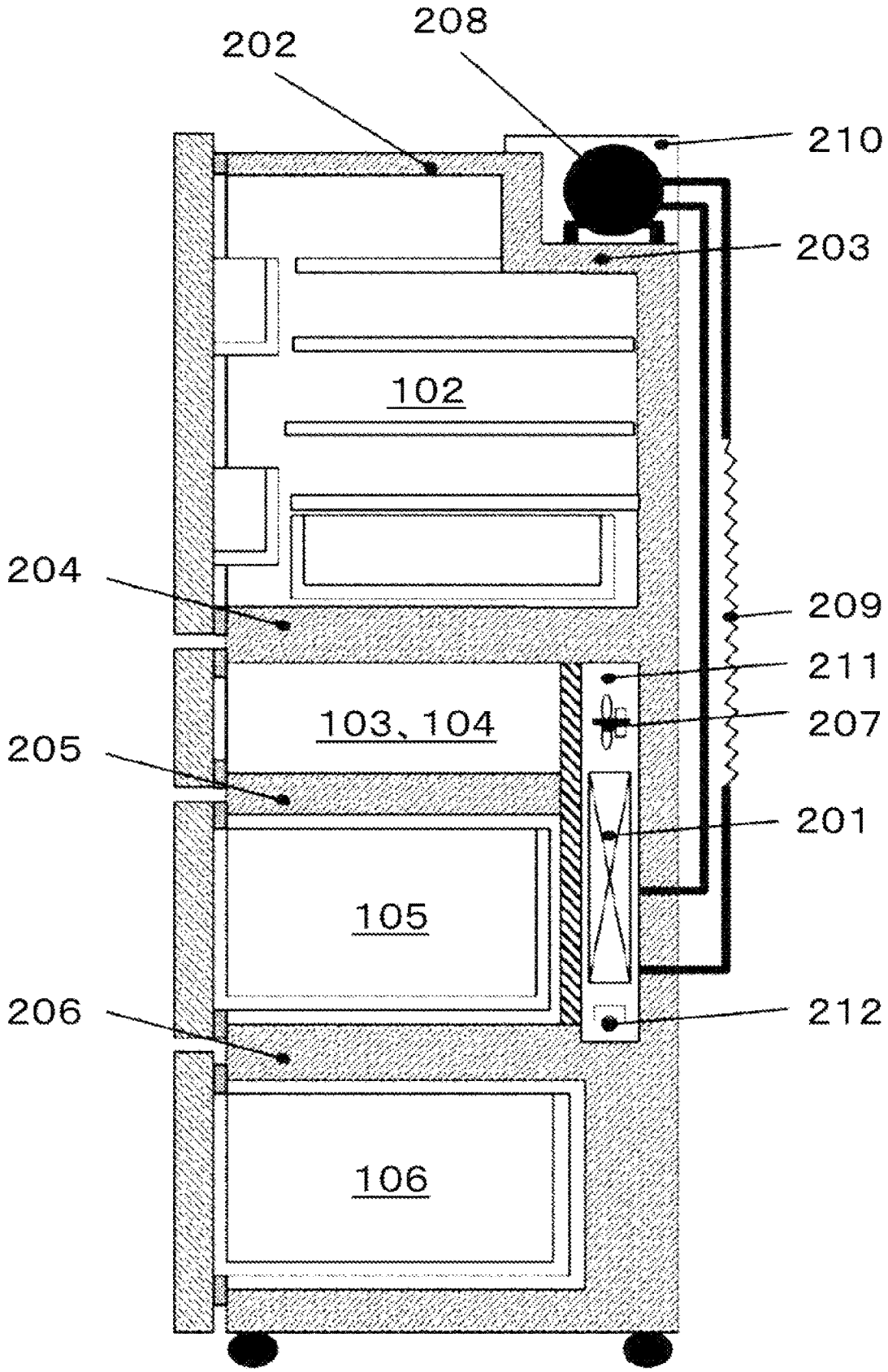
FIG. 2 is a longitudinal sectional view of the refrigerator according to the first embodiment of the disclosure.
Figure 3:
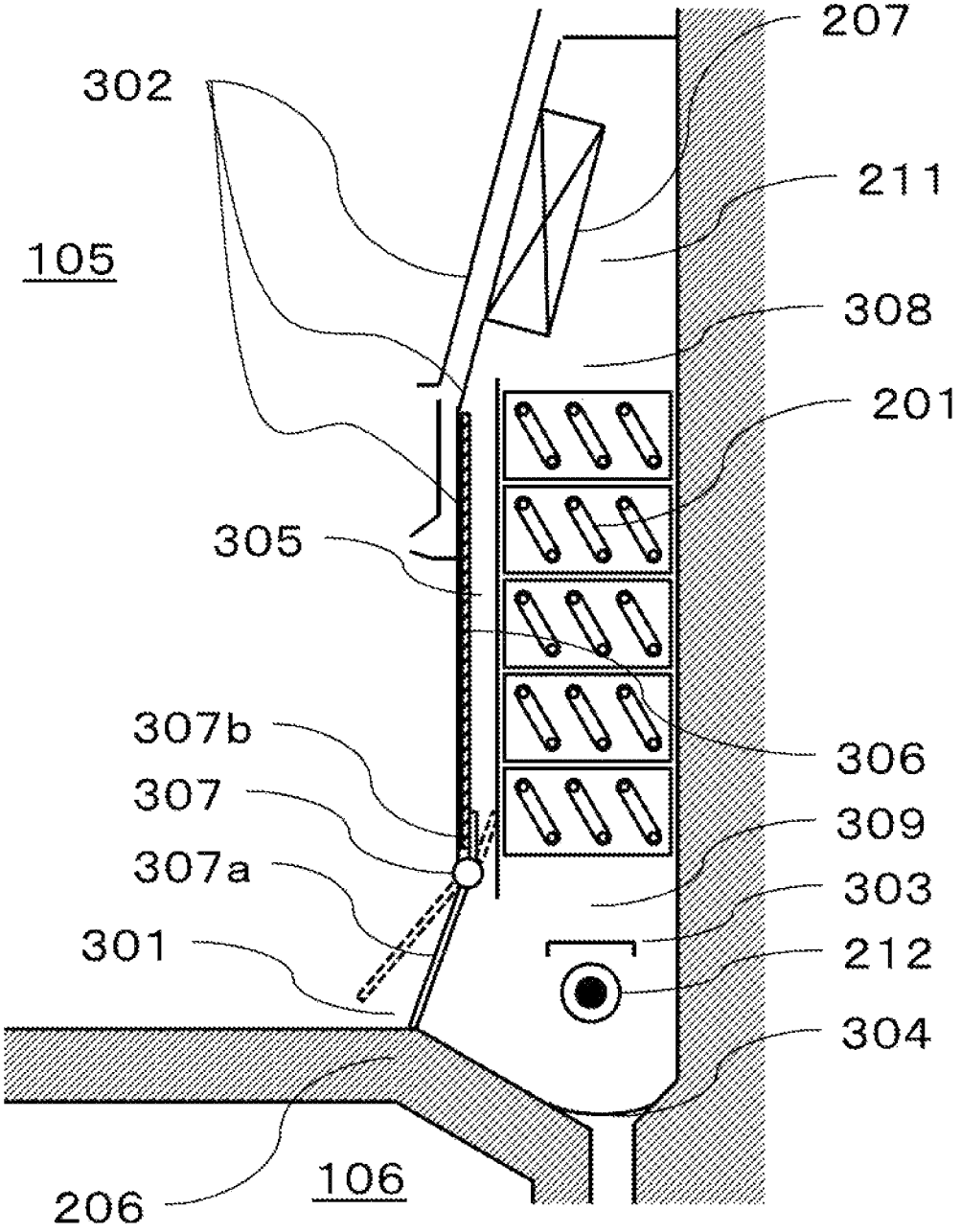
FIG. 3 is a longitudinal sectional view of an area around a cooler in the refrigerator according to the first embodiment of the disclosure.

FIG. 1 is a perspective view of the refrigerator according to the first embodiment of the disclosure. FIG. 2 is a longitudinal sectional view of the refrigerator according to the first embodiment of the disclosure. FIG. 3 is a longitudinal sectional view of an area around a cooler in the refrigerator according to the first embodiment of the disclosure.

<Refrigerator Body>

As shown in FIGS. 1 to 3, the refrigerator body 101 is a heat-insulation body that includes an outer box 107 that opens forward and that is made of a metal material (e.g., an iron material), an inner box 108 that is made of a hard resin (e.g., ABS resins), and a hard urethane foam that is filled into a space between the outer box 107 and the inner box 108 based on foaming.

The refrigerator body 101 is configured by the following members: a refrigeration chamber 102 that is provided in an upper part of the refrigerator body 101; an upper freezing chamber 103 that is provided under the refrigeration chamber 102; an ice-production chamber 104 that is provided under the refrigeration chamber 102 and in parallel with the upper freezing chamber 103; a vegetable chamber 106 that is provided in a lower part of the refrigeration body 101; and a lower freezing chamber 105 that is provided between the upper freezing chamber 103/the ice-production chamber 104 provided in parallel with the vegetable chamber 106.

The front sides of the upper freezing chamber 103, the ice-production chamber 104, the lower freezing chamber 105, and the vegetable chamber 106 may be sealed by use of drawer-type doors (not shown in the figures) in an openable and closable manner. The front side of the refrigeration chamber 102 may be sealed, for example, by use of a hinged door (not shown in the figures) in an openable and closable manner.

Referring to FIG. 2, by forming the top face of the refrigerator 101 in a stair-like shape toward the direction to the rear of the refrigerator, a recessed part is provided on the top face of the refrigerator body 101, and a machine room 210 is provided on the recessed part. That is, the top face of the refrigerator body 101 is configured by a first top face 202 and a second top face 203. A refrigerant is sealed in a freezing cycle that is formed by sequentially and circularly connecting a compressor 208 that is placed in the above recessed part, a water-removing dryer (not shown in the figure), a condenser (not shown in the figure), a heat-release pipe (not shown in the figure), a capillary tube 209, and a cooler 201, and thus, cooling operation is carried out based on the freezing cycle.

For the refrigerant, in recent years, a small amount of flammable refrigerants are often used for the purpose of protection of the environment. In addition, in cases of freezing cycles in which three-way valves and switching valves are used, such functional components can also be provided within the machine room 210.

Moreover, the refrigeration chamber 102, and the ice-production chamber 104/the upper freezing chamber 103 are separated from each other by a first heat-insulation partition part 204.

Furthermore, the ice-production chamber 104 and the upper freezing chamber 103 are separated from each other by a second heat-insulation partition part 109.

Additionally, the ice-production chamber 104/the upper freezing chamber 103, and the lower freezing chamber 105 are separated from each other by a third heat-insulation partition part 205.

In addition, the lower freezing chamber 105 and the vegetable chamber 106 are separated from each other by a fourth heat-insulation partition part 206.

<Area Around the Cooler>

Next, configuration of an area around the cooler 201 in the first embodiment will be described with reference to FIG. 3. A cooling chamber 211 is provided on the rear side of the refrigerator body 101, and the cooler 201 that produces the cold air is provided inside the cooling chamber 211. A cooler cover 302 that covers the cooler 201 is provided at the chamber-facing front side of the cooling chamber 211. A lower part of the cooler cover 302 is provided with a cold-air inlet 301 through which the cold air that has cooled the freezing chamber is returned to the cooler 201.

A connection space 305 is provided over the cooler cover 302. The connection space 305 serves as a path that connects an upper space 308 (an outlet-side space) and a lower space 309 (an inlet-side space) with each other in a place that is different from the place of the space in which the cooler 201 exists. That is, the connection space 305 and the cooler 201 are arranged in parallel with each other.

In addition, areas through which the air can pass between the upper space 308 (the outlet-side space) and the lower space 309 (the inlet-side space) are only the connection space 305 and the cooler 201.

The upper space 308 (the outlet-side space) and the lower space 309 (the inlet-side space) correspond to a space above the cooler 201, and a space under the cooler 201, respectively.

Moreover, an inlet damper 307*a* and a connection damper 307*b* are provided in the cold-air inlet 301 and the connection space 305, respectively. Thus, based on a damper-driving unit 307, the cold-air inlet 301 and the connection space 305 can be opened and closed.

Furthermore, a sheet-shaped heat-insulation material 306 having heat-insulation performance higher than that of a material of the cooler cover 302 is adhered onto the connection-space-facing surface of the cooler cover 302 (i.e., the surface thereof facing the connection space 305). For the heat-insulation material 306, a heat-insulation sheet that is produced by embedding a silica aerogel in pores in a fiber sheet is preferably used. This is because such a heat-insulation sheet has lower heat conductivity, and can be processed to be thinner for use, compared with any other heat-insulation materials. However, any other sheet-shaped heat-insulation materials may also be used therefor.

Additionally, a cold-air-blast fan 207 that delivers the cold air produced in the cooler 201 to each of the storage chambers (i.e., the refrigeration chamber 102, ice-production chamber 104, the upper freezing chamber 103, the lower freezing chamber 105, and the vegetable chamber 106) in a forced-convection-based manner, is provided in the vicinity of the cooler 201.

In this example, such a cold-air-blast fan 207 is provided on the cooler cover 302. The cold air that has been cooled in the cooler 201 moves to the upper space 308 (the outlet-side space). This cold air is delivered into the freezing chamber based on the cold-air-blast fan 207. That is, the cold-air-blast fan 207 serves as a member for delivering the cold air.

A defrosting heater 212 for removing frosts that are adhered onto the cooler 201 and the cold-air-blast fan 207 during the cooling process is provided within the lower space 309 (the inlet-side space) under the cooler 201. In this embodiment, the defrosting heater 212 is formed of a glass tube.

A heater cover 303 that covers the defrosting heater 212 is provided above the defrosting heater 212. Water droplets falling from the cooler 201 during the defrosting process drop directly on a surface of the glass tube that has become in a high-temperature state due to the defrosting operation without the heated cover. In this case, in order not to cause sounds of evaporation of the water droplets, the heater cover 303 may be configured in dimensions equal to or larger than the diameter and the width of the glass tube.

A drain pan 304 that receives falling water derives from melting of frosts adhered onto the cooler 201 is provided under the defrosting heater 212. The drain pan 304 is provided in such a manner that it is integrated with a fourth heat-insulation partition part 206 that corresponds to the bottom side of the freezing chamber.

Although the inlet damper 307*a* and the connection damper 307*b* are driven by the same damper-driving unit 307 in the first embodiment, these members may be driven by providing respective different mechanisms.

<Defrosting Process for the Refrigerator>

A defrosting process for refrigerators will now be described. While refrigerators are subjected to a cooling operation, due to the presence of water in the air that has penetrated thereinto during the opening/closing doors, water that has been adhered to foods placed inside chambers, water derived from vegetables stored in vegetable chambers 106, etc., frosts would gradually be developed and adhered on coolers 201 over time.

When these frosts grow to some degree, heat-exchange efficiencies between the coolers 201 and the circulating cold air will be deteriorated. As a result, it becomes impossible to sufficiently cool the insides of the chambers, and, eventually, this would bring the refrigerators to a state in which it is difficult or even impossible to cool the chambers. Therefore, it is required that frosts adhered onto the coolers 201 are removed in the refrigerators at regular intervals.

Also, in the case of the refrigerator according to the present embodiment, a defrosting process may automatically be carried out after a certain period of time, while the refrigerator according to this embodiment is operated.

During normal operation of the refrigerator before the start of the defrosting process, the inlet damper 307*a* and the connection damper 307*b* are positioned by the damper-driving unit 307 in such a manner that the refrigerator is in a state in which the inlet damper 307*a* opens the cold-air inlet 301, and the connection damper 307*b* closes the connection space 305. The cold air that has been returned from the lower freezing chamber 105 through the cold-air inlet 301 is cooled by the cooler 201. Then, the cold air is delivered into each of the chambers by the cold-air-blast fan 207, and thus, the temperature inside each of the chambers is adjusted.

Then, when the defrosting process is started, the inlet damper 307*a* and the connection damper 307*b* are positioned by the damper-driving unit 307 in such a manner that the refrigerator is in a state in which the inlet damper 307*a* closes the cold-air inlet 301, and the connection damper 307*b* opens the connection space 305. Furthermore, operations of the compressor 208 and the cold-air-blast fan 207 are halted, and then, the defrosting heater 212 is switched on.

By switching on the defrosting heater 212, the surface of the defrosting heater 212 comes into a high-temperature state, and thus, the surrounding air is heated. Additionally, due to radiation from the defrosting heater 212, the surrounding members are also heated.

In general, the cooler 201 is made of aluminum, and thus, exhibits very high emissivity. Therefore, direct heating based on the radiation would not be expected. That is, heat transmission based on the heated air would be a main process. The heated air generates an ascending air current, consequently passes through the cooler 201, and thus, moves upward. Then, the air leads to the upper space 308 (the outlet-side space). The air is cooled in the upper space 308 (the outlet-side space), and passes through the connection space 305, thus moving downward. Subsequently, the air is again heated by the defrosting heater 212, and thus, generates an ascending air current. This process is repeated to thereby remove frosts produced during the cooling process. In that case, the upper space 308 (the outlet-side space), the cooler 201, the connection space 305, the lower space 309 (the inlet-side space), and the defrosting heater 212 are sealed by the cooler cover 302, the inlet damper 307*a* and a wall of the refrigerator body 101. By sealing these elements in this manner, the air is caused to circulate therein.

That is, the upper space 308 (the outlet-side space), the cooler 201, the connection space 305, the lower space 309 (the inlet-side space), and the defrosting heater 212 are located within the space surrounded by the cooler cover 302, the inlet damper 307*a*, and the wall of the refrigerator body 101.

Since any additional power sources such as fans are not used in this embodiment, this embodiment promises excellent energy-saving performance. However, for example, it is possible to use an additional small fan for circulating the air.

In this case, for example, any means (units) that reduces the width of the connection space 305 may be used to cause the resistance of the air passing through the connection space 305 to be higher than the resistance of the air passing through the cooler 201.

Accordingly, the air that has been cooled in the upper space 308 (the outlet-side space) passes through the connection space 305 instead of passing through the cooler 201.

In that case, based on the sheet-shaped heat-insulation material 306 that is placed on the connection-space-facing surface of the cooler cover 302 (i.e., placed on the surface thereof facing the connection space 305), it becomes possible to suppress heat transmission to the lower freezing chamber 105 through the air that is heated by defrosting heater 212, through convection.

Then, since a defrosting sensor (not shown in the figures) is attached onto the cooler 201, the defrosting heater 212 is switched off when the temperature reaches a predefined value, and thus, the defrosting process is halted. By causing frost adhering onto the cooler 201, the drain pan 304, and the cold-air-blast fan 207 to melt based on the above-described defrosting process, the cooler 201 is refreshed.

Since the given elements are sealed in the above-mentioned manner, it becomes possible to cause the frost to melt while preventing the air heated by defrosting heater 212 during the defrosting process from flowing into the lower freezing chamber 105, based on the above structure/process. Accordingly, the refrigerator exhibits improved energy efficiencies during the defrosting process, and delivers excellent energy-saving performance.

Second Embodiment

The second embodiment of the disclosure will be described with reference to FIG. 4. Differences between the first embodiment and the second embodiment will be described. Matters not mentioned in this embodiment are the same as those described for the first embodiment.

Figure 4:
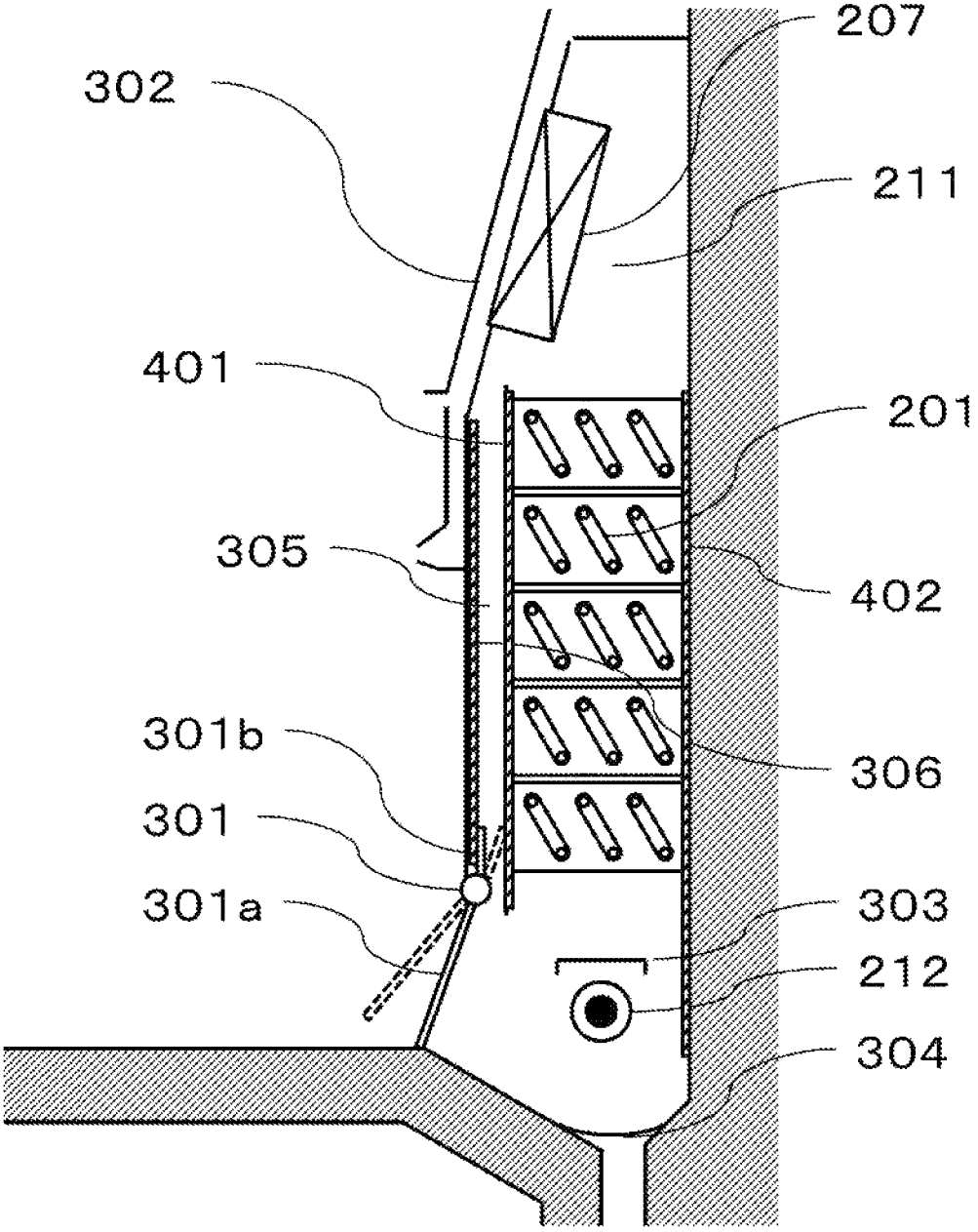
FIG. 4 is a longitudinal sectional view of an area around a cooler in a refrigerator according to a second embodiment of the disclosure.

FIG. 4 is a longitudinal sectional view of an area around a cooler 201 in the refrigerator according to the second embodiment of the disclosure. The flowing two features are different from the structure according to the first embodiment.

The first feature is that a laminate 401 is provided on the lower-freezing-chamber-facing outer surface of the cooler 201 (i.e., on the surface thereof facing the lower freezing chamber 105) in this embodiment. The laminate 401 is formed by laminating a graphite sheet, and a heat-insulation sheet that is formed by embedding a silica aerogel in pores of a fiber sheet. The graphite sheet and the heat-insulation sheet are located in this order from the side of the cooler 201 when the laminate 401 is provided on the cooler 201.

The second feature is that a laminate sheet 402 is further provided on the cooling-chamber-rear-facing surface of the cooler 201 (i.e., on the surface thereof facing the rear of the cooling chamber 211, or at the rear of the refrigerator) in this embodiment. The laminate sheet 402 is formed by laminating a graphite sheet, and a heat-insulation sheet that is formed by embedding a silica aerogel in pores of a fiber sheet. The graphite sheet, and the heat-insulation are located in this order from the side of the cooler 201 when the laminate sheet 402 is provided on the cooler 201 (in the refrigerator).

According to these features, it becomes possible to prevent the heating process based on the defrosting heater 212 from adversely affecting any other sites in the refrigerator. Thus, energy efficiencies during the defrosting process will be improved, and excellent energy-saving performance will be promised.

In the second embodiment, laminates including graphite sheets, and heat-insulation sheets formed by embedding silica aerogels in pores of fiber sheets are used for the laminate 401 and the laminate sheet 402.

Graphite sheets, and heat-insulation materials formed by embedding silica aerogels in pores of fiber sheets are preferable for the laminate 401 and the laminate sheet 402. However, materials of the laminate 401 and the laminate sheet 402 are not limited thereto, and any combinations of high heat-conductive materials and high heat-insulation materials may be used therefor.

Moreover, although the laminate 401 and the laminate sheet 402 are provided in the second embodiment, only the laminate 401 or the laminate sheet 402 may be provided. Furthermore, alternatively, only a heat-conductive material or heat-insulation material may be used. Various options would be possible depending on conditions such as a structure of the cooler 201, a position of the defrosting heater 212, a heat-production amount, etc.

Third Embodiment

The third embodiment of the disclosure will be described with reference to FIG. 5. Differences between the first embodiment and the second embodiment will be described. Matters not mentioned in this embodiment are the same as those described for the second embodiment.

Figure 5:
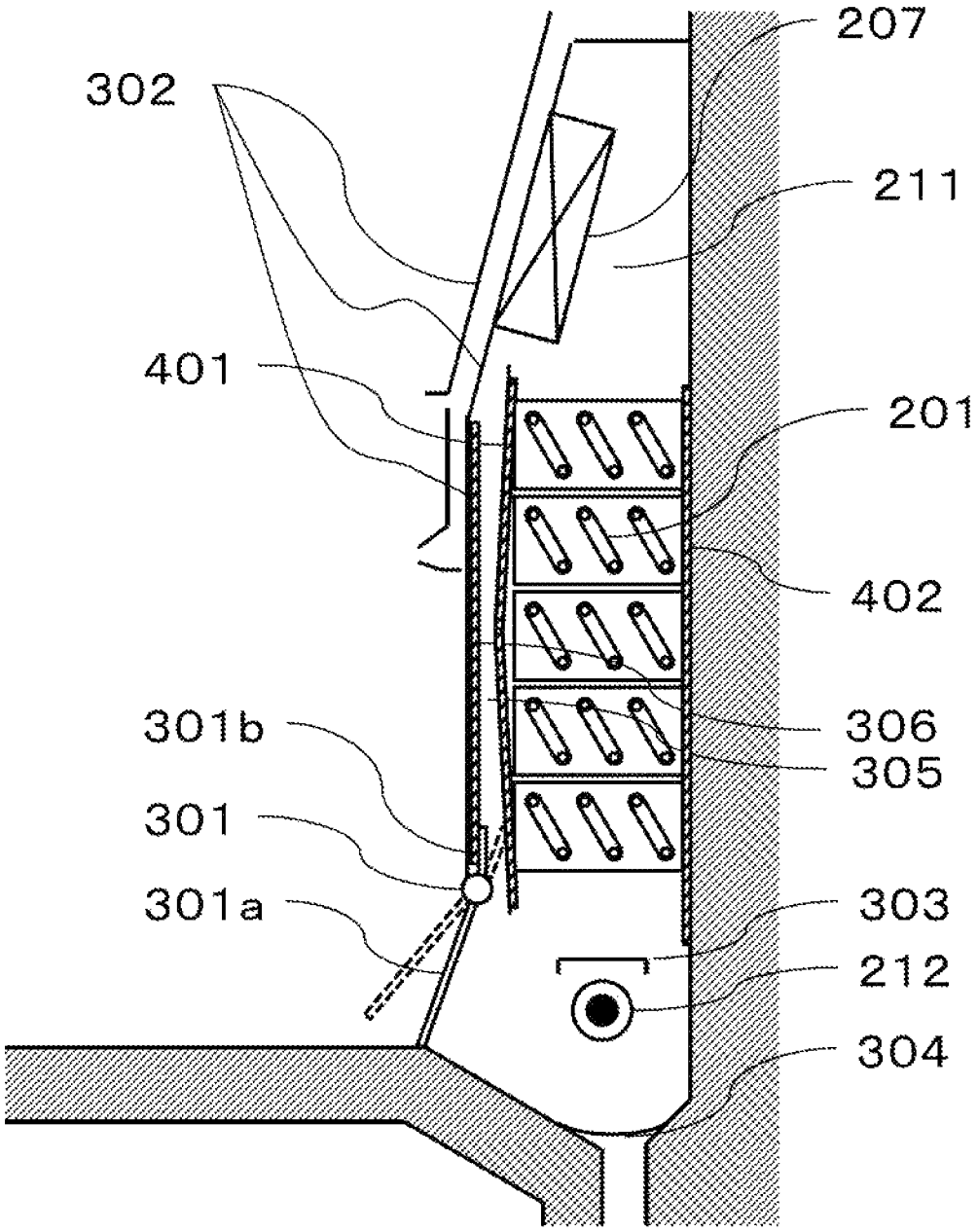
FIG. 5 is a longitudinal sectional view of an area around a cooler in a refrigerator according to a third embodiment of the disclosure.
Figure 6:
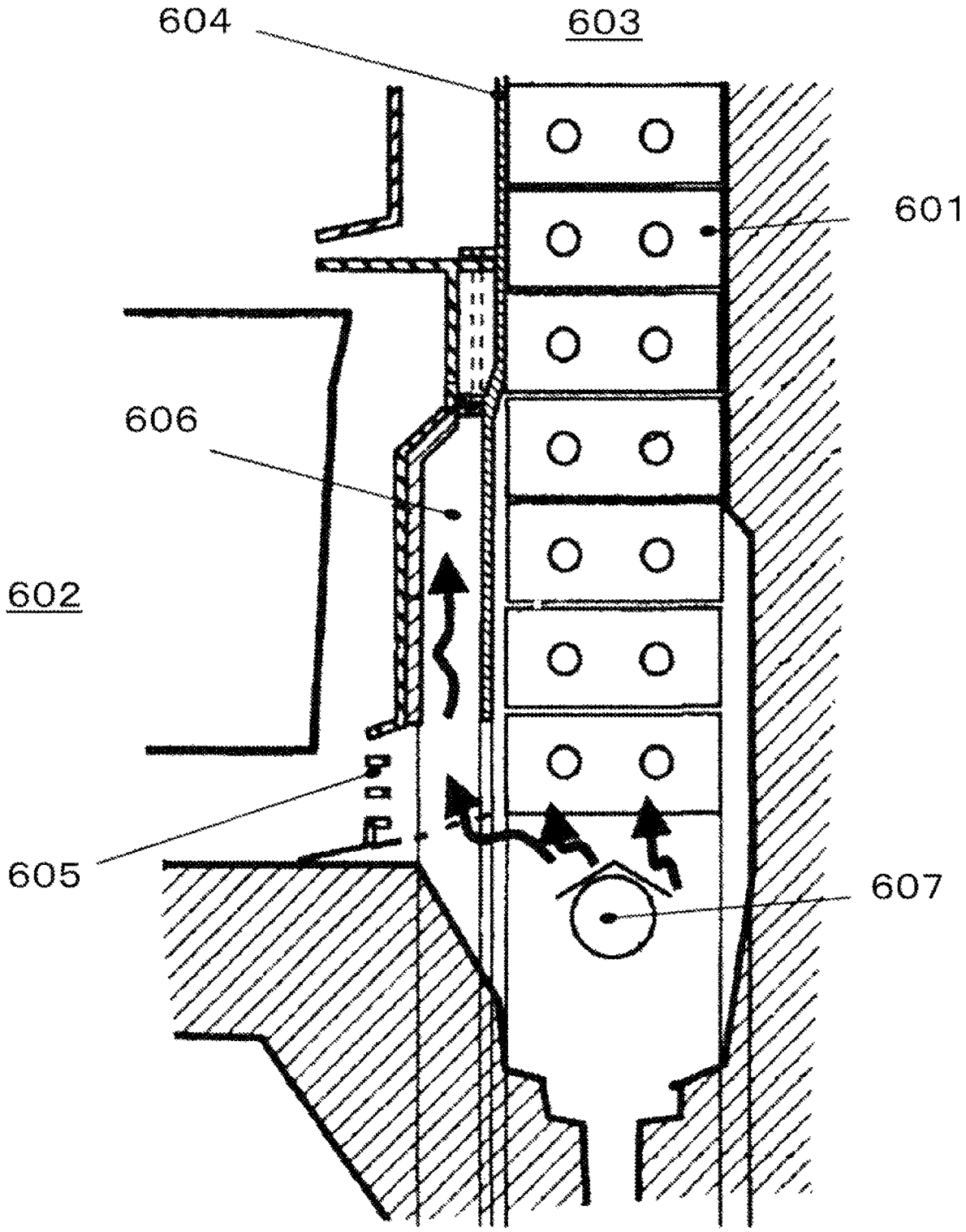
FIG. 6 PRIOR ART
FIG. 6 is a longitudinal sectional view of an area around the cooler in the refrigerator disclosed in JP-A-2010-60188.
Figure 7:
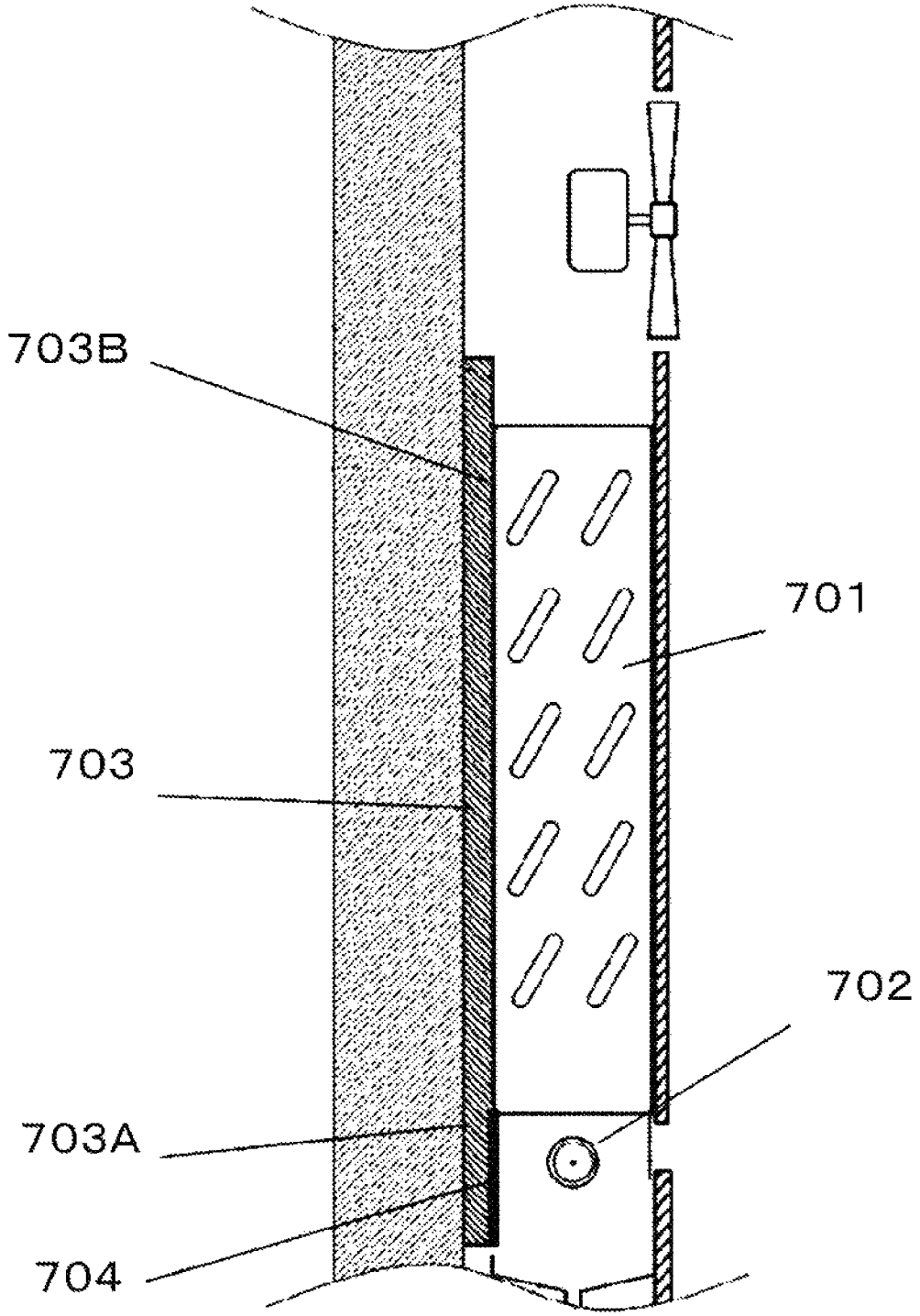
FIG. 7 PRIOR ART
FIG. 7 is a longitudinal sectional view of an area around the cooler in the refrigerator disclosed in JP-2012-57910.

FIG. 5 is a longitudinal sectional view of an area around a cooler 201 in the refrigerator according to the third embodiment of the disclosure. Contrary to the structure according to the first embodiment, a path in the connection space 305 is somewhat narrower. In this case, the cooler-facing surface of the cooler cover 302 (i.e., the surface thereof facing the cooler 201) is formed in a recess shape along the vertical direction, with respect to the cooler 201. The lower-freezing-chamber facing surface of the cooler 201 (i.e., the surface thereof facing the lower freezing chamber 105) may be formed in a projecting shape.

According to the above configuration, even after electromagnetic waves caused due to heat radiation from the defrosting heater 212 are reflected by the cooler 201 and the surrounding members, it makes it possible for the reflected electromagnetic waves to escape to the outside. As a result, energy efficiencies during the defrosting process will be improved, and excellent energy-saving performance will be promised.

In the third embodiment, as described above, the cooler-facing surface of the cooler cover 302 (i.e., the surface thereof facing the cooler 201) is formed in a recess shape along the vertical direction with respect to the cooler 201. However, the surface may be formed in a recessed shape not only along the vertical direction but also along the horizontal direction. Furthermore, not only along the vertical and horizontal directions, but also the surface may be configured in a three-dimensionally-recessed shape such as a sphere.

At least, it is required that a cross-section area of the connection space 305 through which the air passes is not constant but varied.

Overview

The embodiments can be combined.

A refrigerator according to the disclosure has a cooler-defrosting function with enhanced energy efficiencies for the refrigerator, and therefore, can be utilized for improving energy efficiencies during a defrosting process carried out in any other apparatuses involving refrigeration cycles (e.g., air-conditioning systems).

What is claimed is:

1. A refrigerator, comprising:

a cooler that produces cold air;

a defrosting heater that is placed under the cooler;

a cooler cover that covers the cooler, an inlet-side space leading to the cooler, an outlet-side space extending from the cooler, and a connection space connecting the inlet-side space and the outlet-side space to one another;

an inlet damper that opens and closes the inlet-side space; and a connection damper that opens and closes the connection space, wherein when the inlet damper is open, the connection damper is closed, so as to seal the inlet-side space from the outlet-side space, when the inlet damper is closed, the connection damper is open so as to provide a path for air flowing from the outlet-side space located above the cooler to the inlet-side space located below the cooler, and the inlet damper is closed and the connection damper is open when the defrosting heater is on during a defrosting process.

2. The refrigerator according to claim 1, wherein the cooler, the inlet-side space, the outlet-side space, and the connection space are located in a space surrounded by the cooler cover, the inlet damper, and a wall of the refrigerator.

3. The refrigerator according to claim 1, wherein a blast fan is placed on the cooler cover in the outlet-side space.

4. The refrigerator according to claim 1, wherein areas through which the air can pass between the inlet-side space and the outlet-side space are only the connection space and the cooler.

5. The refrigerator according to claim 1, wherein an air resistance of the cooler is smaller than an air resistance of the connection space.

6. The refrigerator according to claim 1, wherein a heat-insulation material is provided on a cooler-facing surface of the cooler cover, wherein the cooler-facing surface faces the cooler.

7. The refrigerator according to claim 1, wherein a heat-insulation material is provided on at least one surface selected from a cooler-cover-facing surface and a refrigerator-rear-facing surface of the cooler, wherein the cooler-cover-facing surface faces the cooler cover, and the refrigerator-rear-facing surface faces the rear of the refrigerator.

8. The refrigerator according to claim 7, wherein a heat-conductive material is provided between the heat-insulation material and the cooler.

9. The refrigerator according to claim 1, wherein a heat-conductive material is provided on at least one surface selected from a cooler-cover-facing surface and a refrigerator-rear-facing surface of the cooler, wherein the cooler-cover-facing surface faces the cooler cover, and the refrigerator-rear-facing surface faces the rear of the refrigerator.

10. The refrigerator according to claim 8, wherein the heat-conductive material is a graphite sheet.

11. The refrigerator according to claim 6, wherein the heat-insulation material is a heat-insulation sheet that is formed by embedding a silica aerogel in pores of a fiber sheet.

12. The refrigerator according to claim 1, wherein the cooler cover has, within the connection space, a part that is recessed with respect to the cooler.

13. The refrigerator according to claim 1, wherein a cross-section area of the connection space through which the air passes is not constant, and is varied.

14. The refrigerator according to claim 1, wherein a cover covering the defrost heater is disposed between the defrost heater and the cooler.

15. The refrigerator according to claim 1, wherein a drain pan for receiving water is disposed below the defrost heater.

16. The refrigerator according to claim 1, further comprising a plurality of cooling chambers and a cold-air inlet for returning air from the plurality of cooling chambers to the inlet-side space, and when the inlet damper is closed none of the plurality of cooling chambers can return cold-air to the cooler via the cold-air inlet.

* * * * *